US007109861B2

(12) United States Patent
Rao

(10) Patent No.: US 7,109,861 B2
(45) Date of Patent: Sep. 19, 2006

(54) SYSTEM AND METHOD FOR ALARM GENERATION BASED ON THE DETECTION OF THE PRESENCE OF A PERSON

(75) Inventor: Ravishankar Rao, Elmsford, NY (US)

(73) Assignee: International Business Machines Corporation, Armonk, NY (US)

( * ) Notice: Subject to any disclaimer, the term of this patent is extended or adjusted under 35 U.S.C. 154(b) by 160 days.

(21) Appl. No.: 10/723,740

(22) Filed: Nov. 26, 2003

(65) Prior Publication Data

US 2005/0110637 A1 May 26, 2005

(51) Int. Cl.
*G08B 13/00* (2006.01)

(52) U.S. Cl. ..... 340/541; 382/118; 707/204; 711/162; 726/23

(58) Field of Classification Search ..... 340/541, 340/522, 573.1, 573.4, 667; 348/135, 143, 348/152, 153, 156, 169, 161, 159; 707/204; 713/200, 201; 711/161, 162; 726/22–23, 726/26–27

See application file for complete search history.

(56) References Cited

U.S. PATENT DOCUMENTS

| | | | | |
|---|---|---|---|---|
| 4,654,703 | A | 3/1987 | Viera | |
| 5,164,827 | A | 11/1992 | Paff | |
| 6,154,852 | A | 11/2000 | Amundson | |
| 6,163,250 | A | 12/2000 | Moskowitz | |
| 6,344,938 | B1 | 2/2002 | Smith | |
| 6,509,926 | B1 | 1/2003 | Mills | |
| 6,717,518 | B1 * | 4/2004 | Pirim et al. | 348/143 |
| 6,720,880 | B1 * | 4/2004 | Gutta et al. | 340/573.4 |
| 2003/0023874 | A1 * | 1/2003 | Prokupets et al. | 713/201 |
| 2003/0070077 | A1 * | 4/2003 | Redlich et al. | 348/182 |

OTHER PUBLICATIONS

A. Hampapur, et al., "Face Cataloger: Multi-Scale Imaging for Relating Identity to Location," IEEE Conference on Advanced Video and Signal Based Surveillance (AVSS'03), Jul. 21-22, 2003, Miami, Florida.

A. Pentland and T. Choudhury, "Face Recognition for Smart Environments," IEEE Computer, Feb. 2000, pp. 50-55.

L. Wiskott, et al., "Face Recognition by Elastic Bunch Graph Matching," IEEE Transactions on Pattern Analysis and Machine Intelligence, Jul. 1997, pp. 775-779.

(Continued)

*Primary Examiner*—Thomas Mullen
(74) *Attorney, Agent, or Firm*—Eustus D. Nelson

(57) ABSTRACT

An automatic monitoring and sensing apparatus is provided for detecting an intruder or a person whose presence is undesired for one reason or another. According to one aspect of the invention, a method and apparatus are provided for automatically monitoring an environment for the presence of a person, and the invention issues an alarm when the environment changes while the person is still present. For example, the invention is capable of detecting a person in an unexpected or dangerous location in the environment, such as a baby or small child who has been left alone in an automobile. The invention initiates remedial action to safeguard the person. In another aspect, the inventive method and apparatus automatically monitors an environment that is intended to be kept secure, such as an environment where a computer system is installed, wherein the apparatus initiates a safeguarding action such as a pre-emptive automatic back-up of data in the computer system.

5 Claims, 3 Drawing Sheets

OTHER PUBLICATIONS

A. Senior, "Face and Feature Finding for a Face Recognition System," In Proceedings of the Second International Conference on Audio and Video-Based Biometric Person Authentication, pp. 154-159, Washington, D.C., Mar. 1999.

D. Penrose, "From the Oil Field to Your Home, The Geo-Mite's Sensitivity Can't Be Beat" Circuit Cellar, Issue 128, Mar. 2001, pp. 40-45.

* cited by examiner

SYSTEM AND METHOD FOR ALARM GENERATION BASED ON THE DETECTION OF THE PRESENCE OF A PERSON

FIELD OF THE INVENTION

The present invention relates to detection of an intruder or other person who is present in a dangerous location, and more particularly, to an apparatus for detecting the presence of a person whose presence in a particular location is likely to result in harm, and taking remedial action.

BACKGROUND OF THE INVENTION

Data backup and recovery are routinely performed in computer systems to safeguard data. Typically computer systems back their data on a periodic basis, usually on a fixed schedule, which occurs on a daily basis or every few hours. Sometimes hardware monitoring capabilities are used to detect faults in the hardware and backup the data in the event of a fault. For instance, the malfunctioning of a disk drive head can trigger the backup of a disk through a second head. These conditions are usually specific to the hardware itself, where specific self-diagnostic checks can be performed. For instance, U.S. Pat. No. 6,344,938 to Smith discloses a method of predicting the impending failure of a disk crash and saving data accordingly. Such self-diagnostic capabilities are provided by the hardware manufacturers themselves. Usually the deployment of these computer systems in different environments is the responsibility of the customers who purchase these systems. The hardware manufacturer may not anticipate the different modes and scenarios under which the system may be deployed.

A scenario that is becoming increasingly plausible in our world is the possibility of physical threat to computer system installations. It is quite possible for an intruder to damage at least a part of a computer system, such as through the use of explosive devices. (This type of intrusion is different from attacks mounted through the computer networks, such as through viruses and worms, which is outside the scope of this invention). In an effort to provide security, surveillance systems may be installed, where cameras monitor an environment. Usually these systems are operated by security personnel who have to watch several video screens simultaneously. The typical action taken when an unauthorized person enters the environment under surveillance is to apprehend the intruder and prevent him or her from proceeding.

Known surveillance systems suffer from a number of disadvantages, such as the fact that human observers of surveillance images or videos may not observe an intruder and/or may not be able to respond quickly enough to prevent an intruder from causing damage to the computer system. Surveillance systems may also respond to changes in the environment in which they operate. In some instances, any change is detected and an alarm is issued, such as a motion detector sensing any moving object. With this type of surveillance system, many false alarms tend to occur. Furthermore, when a surveillance system or an image or video monitoring system is used, an alarm may not necessarily be an appropriate response to the detection of an unauthorized or unexpected person in a monitored environment.

A need therefore exists for a surveillance system that operates automatically in a given environment. In addition, it is desirable for a method or system that is capable of automatically identifying intruders and distinguishing them from regular, authorized personnel. A need also exists for an imaging system that is capable of detecting the presence of a person who may not be an intruder but who is in an unexpected or even dangerous location. Furthermore, a need exists for the ability to automatically monitor an environment coupled with the ability to perform remedial action.

SUMMARY OF THE INVENTION

The present invention provides an automatic monitoring and sensing apparatus that applies to a wide variety of settings for detecting an intruder or a person whose presence is undesired. For example, the inventive method and apparatus may automatically monitor an environment that is intended to be kept secure, such as an environment where a computer system is installed, wherein the invention initiates a safeguarding action such as a pre-emptive automatic back-up of data in the computer system. The invention also provides a method and apparatus for automatically monitoring an environment for the presence of a person, and it issues an alarm when the environment changes while the person is still present. For example, the invention is capable of detecting a person in an unexpected or dangerous location in the environment, such as a baby or small child who has been left alone in an automobile. The invention initiates remedial action to safeguard the person.

One aspect of the invention is directed to a system for detecting the presence of a person in an environment that is monitored by a surveillance system that has at least one sensor, wherein the person's presence in the environment is likely to result in harm. The system includes a face detection module coupled to the at least one sensor and an electronic control module capable of receiving a signal output from the face detection module. The electronic control module sends a signal to initiate remedial action to reduce the likelihood of harm.

In another aspect of the invention, a method is provided for safeguarding a person whose presence is detected in the confined space that includes a surveillance system that uses at least one sensor. The method uses a face detection module, coupled to the at least one sensor, to detect a face in the confined space in response to a signal output from the surveillance system. In response to an electronic signal indicating the presence of a hazardous condition in the confined space, the inventive method initiates a remedial action.

According to another aspect of the invention, an intrusion detection system is provided for an environment being monitored by a surveillance system that has at least one sensor, wherein the environment includes a computer system and a data backup system. The intrusion detection system has a face detection module coupled to the at least one sensor and a face recognition module for comparing a detected face to a known database of faces and for identifying a scenario in which a high likelihood of illegitimate access to the environment exists. An electronic control module is provided for initiating preemptive data backup in response to the identification of a scenario in which a high likelihood of illegitimate access to the environment exists.

Yet another aspect of the invention is directed to a method for backing up data preemptively in an environment that includes a surveillance system that uses at least one sensor, a computer system and a data backup system. In response to a signal output from the surveillance system, the method of the invention identifies a scenario in which a high likelihood of illegitimate access to the environment exists, and initiates a data backup.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

The present invention will be explained below with reference to two preferred embodiments. One preferred embodiment relates to an apparatus that automatically monitors an environment that is intended to be kept secure, such as an environment where a computer system is installed, wherein the apparatus initiates a safeguarding action such as a pre-emptive automatic back-up of data in the computer system. A second preferred embodiment relates to an apparatus that monitors an environment for the presence of a person, and issues an alarm when the environment changes while the person is still present. It is to be understood, however, that the present invention is not limited to the particular environments of the preferred embodiments. The automatic monitoring and sensing apparatus of the invention more generally applies to a wide variety of settings for detecting an intruder or a person whose presence is undesired for one reason or another. For example, the invention may be used to detect the presence of a person in an environment such as a confined space where conditions are hazardous to a person's health or well-being, wherein the apparatus of the invention initiates steps to safeguard the person and/or to send a signal seeking help. Various embodiments of the invention are applicable to environments with surveillance systems, and to, for example, military, industrial, commercial, residential and mobile environments.

According to one embodiment, the invention provides a surveillance system that monitors one or more computer systems in a particular environment. The invention is capable of identifying situations in which there is a high likelihood that an intruder is present, and the invention is capable of triggering automatic backup of data in the computer system. To eliminate or significantly reduce the occurrence of false alarms, the invention provides capability for screening out abnormal situations from normal ones. Such screening is preferably done through face detection and recognition. Multiple security features, such as ID cards, fingerprint scans, face scans, etc., may be used simultaneously to reduce the false alarm rate even further. In the event that an abnormal situation is detected (such as the presence of an intruder), a signal is sent to the computer systems in the environment, thereby causing data to be backed up immediately.

In addition to the normal alarms generated upon intrusion detection (such as sirens etc.), the surveillance system also initiates a backup of the data in the computer system. This pre-emptive automatic backup is an important way to safeguard data, and is not known to have been hitherto used or addressed. Additionally, there is no known research in the field of face detection that has addressed the problem of data backups. Furthermore, there does not appear to be any work directed to the problem of performing data backups which has also addressed face detection.

Figure 1:
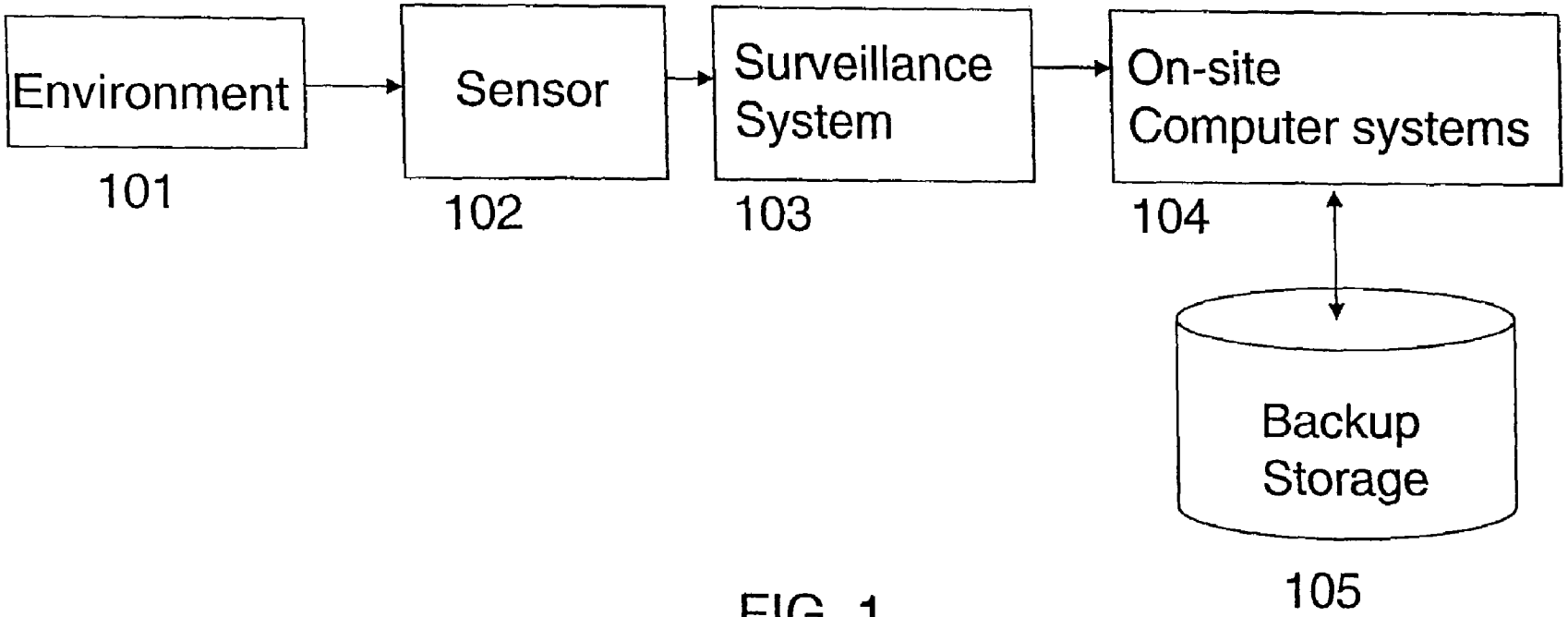
FIG. 1 is a schematic for a preferred embodiment of the invention wherein a surveillance system operates with a data backup and recovery system.

FIG. 1 describes the overall architecture of a preferred embodiment of the invention. One or more sensors 102 monitor an environment 101. The environment may consist of the areas that provide physical access to a system whose protection is desired. For instance, this may consist of driveways, walkways, parking lots, entrance aisles to buildings and so on. The sensor transforms objects in the environment into signals that are transmitted to the surveillance system 103. The sensor could be a video camera, an infrared sensor, a motion-detector or any other such device. According to a preferred embodiment, a video camera is used. By decoding and interpreting the signals from the sensor, the surveillance system is able to make inferences about the objects in its environment. The surveillance system 103 may communicate with an on-site computer system or systems 104. Under specific conditions, surveillance system 103 is able to issue a signal to computer system 104 to back up data immediately to one or more backup storage devices 105. Preferably, backup storage 105 is located off-site, to minimize the loss of information in the event of an attack or catastrophe.

Figure 2:
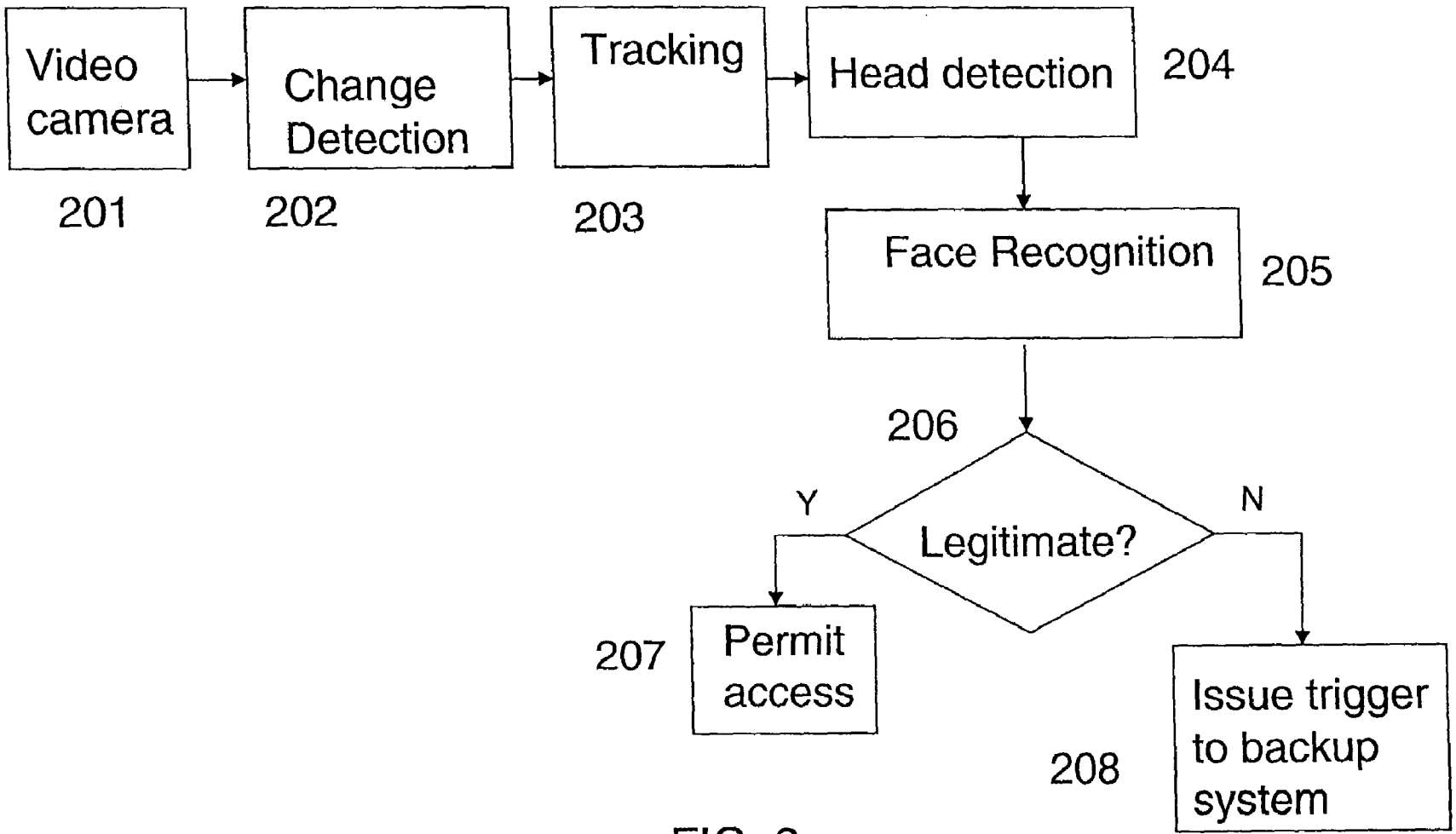
FIG. 2 shows the components of a surveillance system in accordance with the embodiment of FIG. 1.
Figure 3:
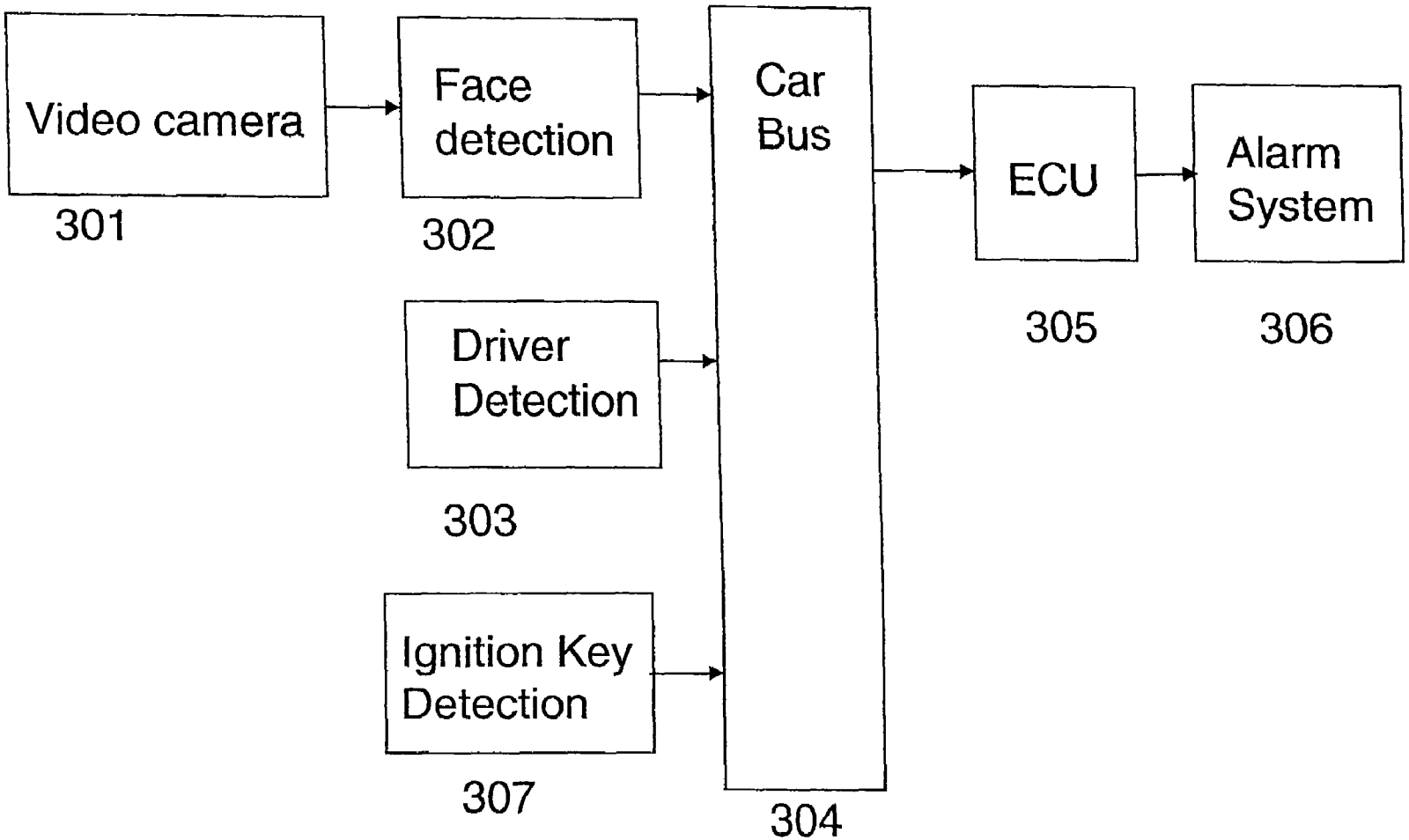
FIG. 3 is a schematic for an embodiment of the invention wherein a surveillance system detects the unexpected presence of a person in a vehicle.

The system is now described in more detail, as shown in FIG. 2. A preferred embodiment deploys a video camera sensing device 201, which is able to collect visible-light images of the environment of interest. The invention may employ a surveillance apparatus such as the one disclosed in U.S. Pat. No. 6,509,926, entitled "Surveillance Apparatus for Camera Surveillance System", the disclosure of which is incorporated herein by reference.

The initial processing of the inventive system is performed by change detection module 202, which performs background subtraction and filtering to remove small areas due to noise. The change detection module identifies new regions in the image that did not exist before. These regions are caused by new objects moving into the field of view or by the movement of existing objects within the field of view. The output of the change detection module is sent to a tracking module 203 which constantly keeps the new objects in the field of view. The tracking module sends its output to a head detection module 204 which applies geometric rules to identify the location of the head of a person in the image. Processing stages 202–204 are described in further detail in "Face Cataloger: Multi-scale imaging for relating identity to location," by A. Hampapur et al, IEEE Conference on Advanced Video and Signal Based Surveillance (AVSS'03), Jul. 21–22, 2003, Miami, Fla., the disclosure of which is incorporated herein by reference.

Once the head is detected, a face recognition algorithm 205 is applied to the detected face. The invention may apply a face recognition algorithm such as that described in "Face recognition by elastic bunch graph matching," by L. Wiskott et al, IEEE Transactions on Pattern Analysis and Machine Intelligence, July 1997, pp. 775–559, the disclosure of which is incorporated herein by reference. Examples of alternative algorithms for face recognition are described in the survey of successful face recognition algorithms by A. Pentland and T. Choudhury in "Face Recognition for Smart Environments," IEEE Computer, February 2000, pp 50–55, the disclosure of which is also incorporated herein by reference. Those of ordinary skill in the art will recognize that the invention allows for the use of any of a variety of different algorithms without departing from the scope and spirit of the invention.

The face recognition module 205 is able to compare the detected face against known faces in a database of authorized accessors to the site. A determination is made as to whether the detected face is legitimate or known 206 or not. If the face matches a known person, that person may be granted access 207 to the site pending further verification, such as a security badge, or other biometric information such as fingerprints. If there is a possibility of illegitimate entry, the surveillance system preferably issues a trigger or signal 208 to the backup system to initiate a data backup.

One aspect of this invention is that the surveillance system need not do a perfect job in identifying a person. Indeed, accuracy rates in face recognition systems are typically in the 80% range. According to a preferred embodiment of the invention, a conservative action of pre-emptive data backup is performed in the event that there is a suspicion of illegitimate entry into a location where a computer system or systems are intended to be protected from unauthorized access. It certainly does not hurt the system for its data to be backed up, and there is little loss of operability while backup is taking place. Efficient backup algorithms such as incremental backups can be used to minimize the amount of data to be backed up, as those of ordinary skill in the art will recognize. For example, in a preferred embodiment, the method and apparatus disclosed in U.S. Pat. No. 6,154,852, entitled "Method and Apparatus for Data Backup and Recovery," the disclosure of which is incorporated by reference herein, may be used to perform data backup and recovery. The apparatus of U.S. Pat. No. 6,154,852 uses a plurality of tape drives in parallel and constitutes a fast and efficient method for data backup and recovery.

According to another preferred embodiment of the invention, a face-detection system may be used to monitor the inside of a vehicle. According to this aspect of the invention, face detection may be used to detect, for example, whether a person such as a baby is in the vehicle while there is no driver. A video camera 301 preferably serves as a sensor for the face-detection system 302. The camera is able to capture visible-light images of the interior of the vehicle. The camera may be mounted in the front of the vehicle, pointing backwards. Since cameras are quite inexpensive, it is possible to use multiple cameras inside the vehicle. The face-detection system may employ techniques such as those described in Hampapur et al. and in "Face and feature finding for a face recognition system", by Andrew Senior, in Proceedings of the Second International Conference on Audio and Video-based Biometric Person Authentication, pp. 154–159, Washington D.C., March 1999, the disclosure of which is incorporated by reference herein.

Face detection may involve performing background subtraction, followed by skin-tone classification and Fisher discriminant detection, as those of ordinary skill in the art will recognize. According to one embodiment of the invention, the output of the face-detection system may be fed to an on-board car bus 304, which carries data and control signals to the Electronic Control Unit, ECU, 305. The ECU 305 controls the operations of the electronics within the car. A driver detection system 303 also sends its output to the ECU via the car bus 304. A variety of different possible implementations of the driver detection system may be used by the present invention. In one implementation, the face detection scheme 302 is used. This identifies that a driver is present in the driver's seat. In another implementation, a driver detection module 303 such as, for example, a pressure sensor on the driver's seat identifies the presence of a driver. Optionally, an ignition key detection system 307 may identify whether an ignition key is in its expected position.

The ECU 305 may combine the outputs of the face detection module 302, driver detection module 303 and/or ignition key detection module 307 to determine whether a person has been left behind in the vehicle by the driver. For instance, if a face is detected inside the vehicle while there is no driver and there is no ignition key, an alarm system 306 may be activated. The alarm system may notify the driver that a person has been left inside the vehicle. A small delay time in the system may be introduced in the event that the driver is letting the person out of the vehicle, or removing a baby from the vehicle. Another condition that can be detected is whether all the windows are closed while there is a person in the vehicle, and there is no driver and no ignition key. In addition to sending a notification alarm to the driver, the inventive system may perform other forms of remedial action. For example, in hot weather, the ECU may cause the vehicle windows to be activated by at least partially rolling one or more windows down to reduce heating inside the vehicle. This will avoid heat injury to the person inadvertently left behind in the vehicle. Similarly, in cold weather, the ECU may cause the heater to be turned on to reduce the effects of cold temperatures upon the person left inside the vehicle. Other combinations of conditions can be similarly derived by the ECU. The essential aspect of this embodiment of the invention is the ability to identify the presence of a person inside the vehicle through the use of face detection techniques.

Other implementations of the invention may be used in environments other than a vehicle. In general, the invention may be used to detect the presence of a person in a confined space or environment where harm is likely to result. The person's presence may be authorized or not, or may be expected or not. The person may be the source of the harm, such as in the scenario described above, wherein an intruder is likely to cause damage to equipment or items that may be stored in the environment or confined space. Alternatively, the person may be subject to danger by being in a confined space or environment where, for example, environmental conditions are dangerous or hazardous to human life or health. The invention may be coupled to or may include one or more detection systems that monitor temperature, air pressure, chemical composition of the air, noise level, lighting conditions, or water or fluid level in the confined space; or monitor whether access doors, hatchways, vents, valves or other openings are closed or locked. The Electronic Control Unit of the invention may then send a signal causing remedial action to be initiated, in response to the condition that is sensed, such as opening up the confined space if possible, providing a supply of fresh air, turning lights on, draining fluids or locking or unlocking accessways or openings, etc., as a person of ordinary skill in the art would recognize to be appropriate to the particular environment. Such remedial action is preferably taken by one or more environmental control systems, such as an electronic, electromechanical, mechanical, plumbing, chemical, HVAC or security system (not shown), or combination thereof, in addition to alarm system 306. The remedial action is taken to safeguard the person and/or part of the environment in which the person's presence is detected. For example, the remedial action could include securing (e.g., closing or locking) an accessway to a portion of the environment so that an intruder is prevented from damaging an item that is located in that portion of the environment. Alternatively, an accessway may be locked to minimize or prevent the harmful effects of a dangerous or hazardous item or condition in the environment when the presence of a person is detected in the environment or confined space.

Although illustrative embodiments of the present invention have been described herein with reference to the accompanying drawings, it is to be understood that the invention is not limited to those precise embodiments, and that various other changes and modifications may be made by one skilled in the art without departing from the scope of spirit of the invention. For example, the invention may be implemented in software and may be embodied as a computer program product or an article of manufacture, comprising at least one computer usable medium having computer readable program code means embodied therein for performing a data backup of a computer system, for example, or for initiating an alarm in response to the detection of the presence of a person in a confined space. The computer program product or article of manufacture may comprise computer readable program code means for performing the method of the invention as described in greater detail hereinabove. The foregoing description should therefore be considered as merely illustrative of the principles of the present invention, and not in limitation thereof.

What is claimed is:

1. An intrusion detection system for an environment being monitored by at least one sensor, wherein the environment includes a computer system, the intrusion detection system comprising:

a face detection module coupled to the at least one sensor, the sensor providing sensor input to the face detection module such that one or more faces are detectable;

a face recognition module for comparing a detected face to a known database of faces and for identifying a scenario in which a high likelihood of illegitimate access to the environment exists; and an electronic control module for initiating a preemptive data backup of the computer system in response to the identification of a scenario in which a high likelihood of illegitimate access to the environment exists.

2. The system as claimed in claim 1, wherein the at least one sensor comprises an image monitoring system.

3. The system as claimed in claim 2, further comprising a change detection module for processing at least one image signal from the image monitoring system.

4. The system as claimed in claim 3, further comprising a tracking module for receiving an output signal from the change detection module.

5. The system as claimed in claim 4, further comprising a head detection module capable of receiving an output signal from the tracking module.

* * * * *